US005613331A

United States Patent [19]

LaGanke

[11] Patent Number: 5,613,331

[45] Date of Patent: Mar. 25, 1997

[54] MODULAR OIL CHANGE AND LUBRICATION CENTER FOR VEHICLES

[76] Inventor: Timothy J. LaGanke, 14054 Sweetbriar La., Novelty, Ohio 44072

[21] Appl. No.: 367,446

[22] Filed: Dec. 29, 1994

[51] Int. Cl.[6] ..... E02D 27/00

[52] U.S. Cl. ..... 52/169.7; 52/79.1

[58] Field of Search ..... 52/169.7, 79.1, 52/79.7, 79.11, 79.14, 174, 169.6; 137/236.4

[56] References Cited

U.S. PATENT DOCUMENTS

| | | | |
|---|---|---|---|
| 704,899 | 7/1902 | Miller . | |
| 1,337,408 | 4/1920 | Morris . | |
| 1,654,073 | 12/1927 | Fagan . | |
| 3,007,212 | 11/1961 | Gazin . | |
| 4,284,173 | 8/1981 | Patterson . | |
| 4,352,322 | 10/1982 | Brauer . | |
| 4,497,149 | 2/1985 | Schott et al. . | |
| 4,539,780 | 9/1985 | Rice | 52/169.6 |
| 5,396,745 | 3/1995 | Klein | 52/169.6 |

*Primary Examiner*—Creighton Smith
*Attorney, Agent, or Firm*—Tarolli, Sundheim, Covell, Tummino & Szabo

[57] ABSTRACT

The present invention resides in a modular building construction for a vehicle oil change and lubrication center. The building comprises at least two components. Each component is a prefabricated section. One of the components is a one-piece below-grade vault, preferably of cast reinforced concrete. The vault has a floor and upstanding walls, and is dimensioned so that it can be transported on a truck-trailer bed. The vault has an open top. A second component comprises an above-grade enclosure. The above-grade enclosure is supportable by the walls of the below-grade vault. The above-grade enclosure has a floor opening, and a door access for a vehicle which allows a vehicle to be positioned over the floor opening. The floor opening is aligned with the vault open top and permits access from the enclosure to the vault. Means are provided releasably holding the enclosure to the vault. The vault has a height dimension which allows an attendant to stand up in the vault while servicing a vehicle positioned over the floor opening.

40 Claims, 5 Drawing Sheets

MODULAR OIL CHANGE AND LUBRICATION CENTER FOR VEHICLES

BACKGROUND OF THE INVENTION

1. Technical Field

The present invention relates to a modular building construction, and more particularly to a vehicle oil change and lubrication center which can be located at one site, and then, if necessary, moved to another site.

2. Description of the Prior Art

It is known to provide a building with a modular construction so that the building can be located at a site and then, if necessary, moved to another site. Many businesses have a break-even point at which a minimum sales volume has to be met before a profit is made. It may be desirable to relocate the business from a selected site should the business fail to meet the minimum sales volume. A modular construction can facilitate such relocation.

U.S. Pat. No. 1,654,073 discloses a drain pit and grease rack for use in connection with garages and gasoline stations. The construction of the drain pit permits it to be sold as an article of commerce and shipped to a point of use. If relocation is desired, the drain pit can be lifted from its place of use and transported to a new location. A primary component of the drain pit is a fabricated steel shell.

U.S. Pat. No. 4,352,332 discloses a prefabricated housing which can be inserted into an excavation and used for servicing a vehicle positioned over the housing.

SUMMARY OF THE INVENTION

The present invention resides in a modular building construction for a vehicle oil change and lubrication center. The building comprises at least two components. Each component is a prefabricated section. One of the components is a one-piece below-grade vault, preferably of cast reinforced concrete. The vault has a floor and upstanding walls. The vault is dimensioned so that it can be transported on a truck-trailer bed. The vault has an open top. A second component comprises an above-grade enclosure. The above-grade enclosure is supported by the upstanding walls of the below-grade vault. The above-grade enclosure has a floor opening, and a door access for a vehicle which allows a vehicle to be positioned over the floor opening. The floor opening is aligned with the vault open top and permits access for an attendant from the enclosure to the vault. Means are provided releasably holding the enclosure to the vault. The vault has a height dimension which allows the attendant to stand up in the vault while servicing a vehicle positioned over the floor opening.

The vault preferably has a rectangular configuration, when viewed from the top, and comprises opposed, upstanding end walls and opposed, upstanding side walls. The above-grade enclosure is supported by the vault end and side walls, and overhangs the end and side walls.

Preferably, the building above-grade enclosure comprises at least two sections which are separable. Each section is dimensioned to fit onto a truck-trailer bed. The sections, when fastened-together, provide a floor area greater than the area of the open top of the vault. The enclosure comprises floor beams which seat on the upstanding walls of the vault.

In one embodiment of the present invention, the above-grade enclosure comprises two sections which are separable. Each section comprises a floor plate and a beam layout beneath the floor plate. The beam layout comprises a first set of beams which engage the vault upstanding walls, a second set of beams which define the floor opening, and a third set of beams which support the floor perimeter. The beams are interconnected other than by the floor plate.

Preferably, the two sections of the above-grade enclosure are enclosure halves attached to each other at the enclosure centerline. The enclosure centerline and vault centerline are aligned. The door access for a vehicle and the opening in the enclosure floor are offset to one side with respect to said centerlines, so that the door access and the floor opening are primarily in one of said enclosure halves. The building comprises accessories. The accessories are in the other of said enclosure halves, along a side wall of said other half.

Preferably, the building contains receptacles for new and used oil. The oil receptacles are positioned in the vault. The vault has a work area for an attendant in the vault. The work area is below the floor opening, and thus is in one side of the vault. The vault is sized to accommodate the oil receptacles in the other side of the vault, removed from the vault work area.

The present invention also resides in a method of construction for a modular building for a vehicle oil change and lubrication center comprising the steps of (a) providing an excavation; (b) positioning a one-piece vault in said excavation, said vault being open-topped; (c) providing an above-grade enclosure comprising a floor, opposed walls, a vehicle access opening in one of said walls for access by a vehicle to said enclosure, and an opening in said floor aligned with said vehicle access opening; and (d) positioning said building enclosure on said vault so that it is supported by the vault, said enclosure floor opening being aligned with said vault open top.

BRIEF DESCRIPTION OF THE DRAWINGS

Further features of the present invention will become apparent to those skilled in the art to which the present invention relates from reading the following specification, with reference to the accompanying drawings, in which.

DESCRIPTION OF PREFERRED EMBODIMENTS

Figure 1:
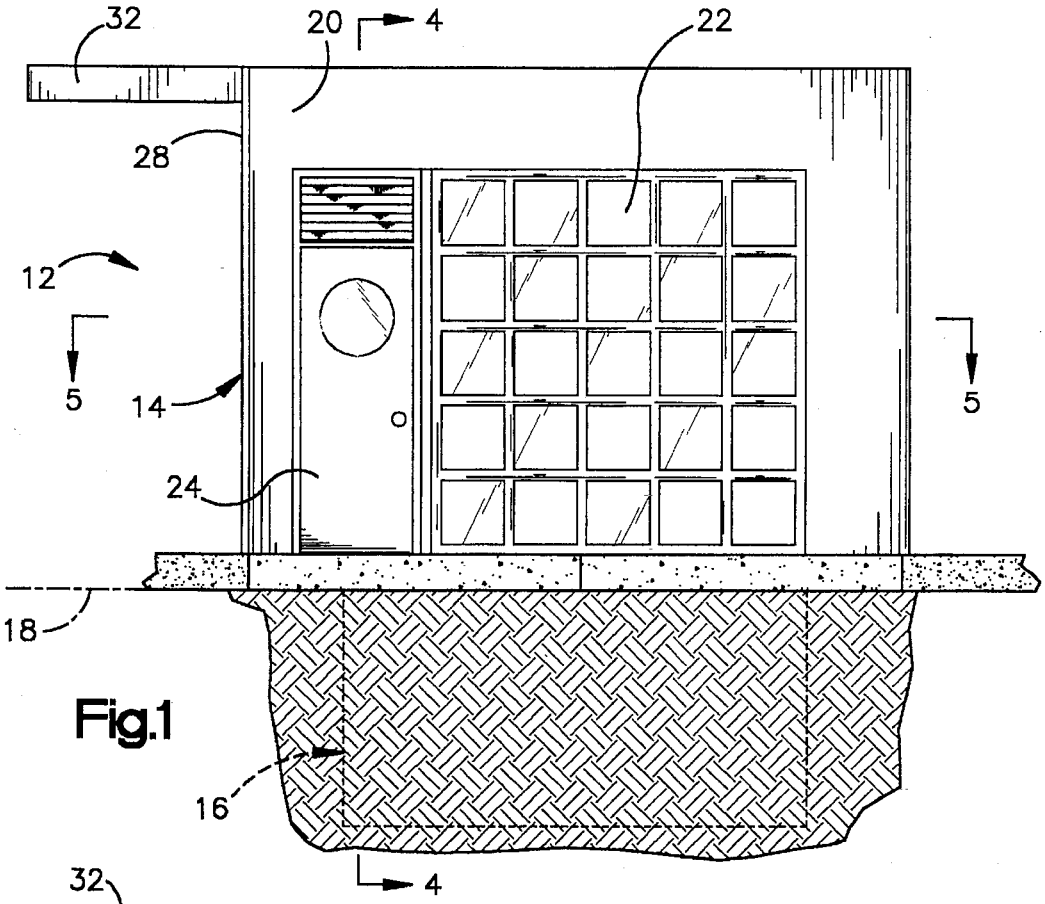
FIG. 1 is a front elevation view of a modular building of the present invention, showing a below-grade vault in phantom lines, and an above-grade enclosure in solid lines.

Referring to FIG. 1, the building 12 of the present invention comprises an above-grade enclosure 14 and a below-grade vault 16, shown in phantom lines in FIG. 1. The above-grade enclosure 14 functions as one bay of an oil change and lubrication center. The grade 18 is the plane of separation between the vault 16 and the enclosure 14, and is essentially at ground level.

The above-grade enclosure 14 has a front wall 20, an enlarged front door 22 in the front wall which can be raised for access by a vehicle to the enclosure 14, and a smaller door 24 to the side of the door 22, which can be opened for access by a person to the enclosure. The door 24 can also be used by an attendant in the building to greet a customer in a vehicle in front of the building.

Figure 2:
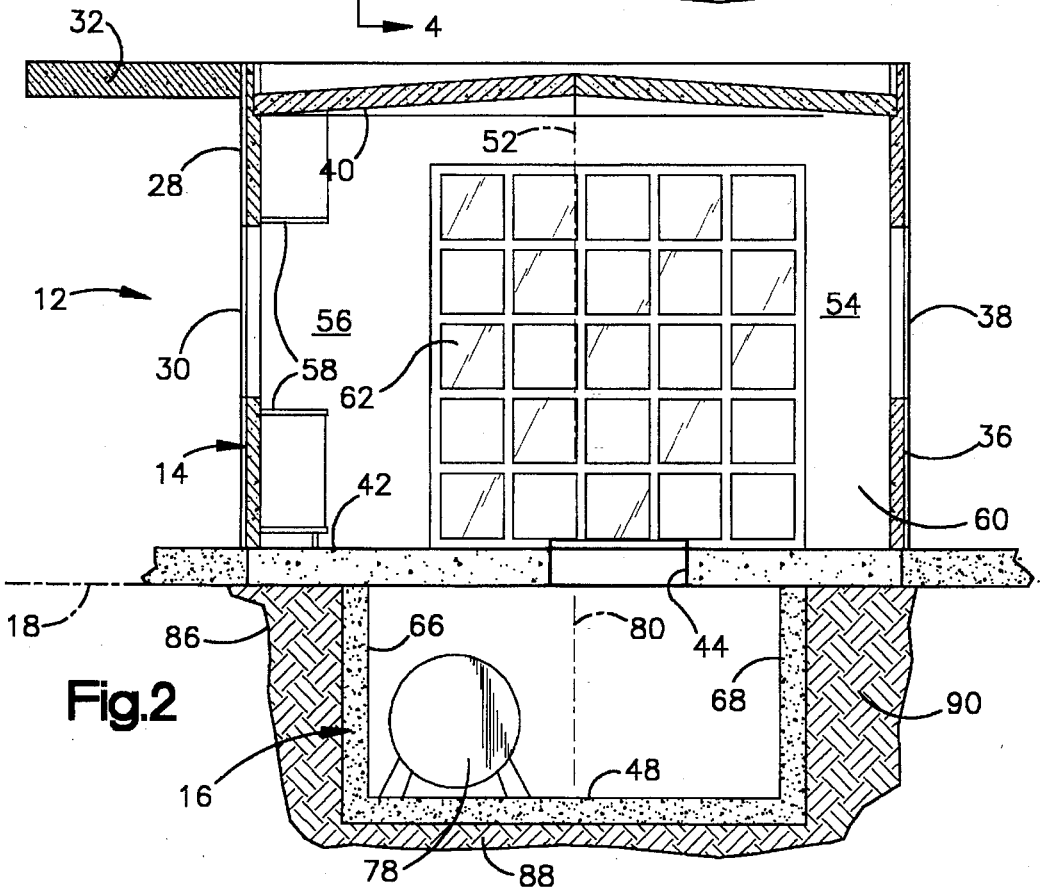
FIG. 2 is a section elevation view of the building of FIG. 1 taken along line 2—2 of FIG. 3.
Figure 3:
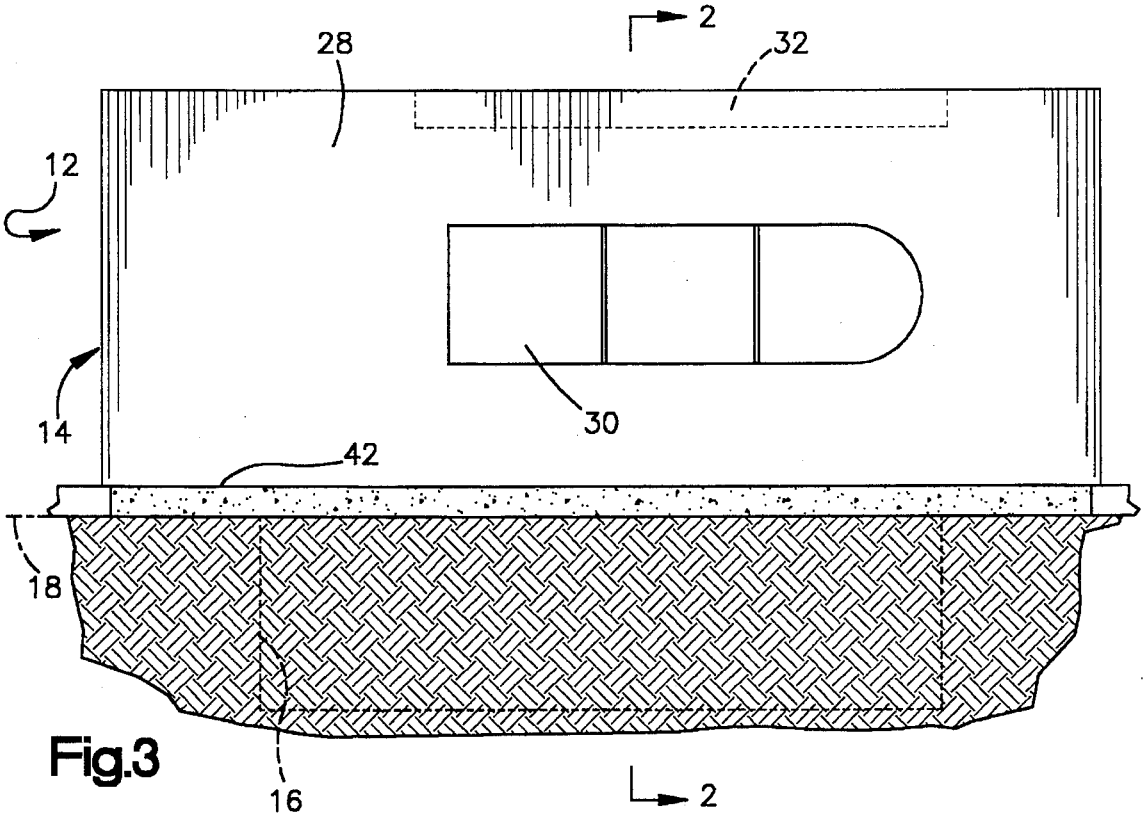
FIG. 3 is a side elevation view of the left side of the building of FIG. 1.

A left side view of the building 12 is shown in FIG. 3. The above-grade enclosure 14 has a left side wall 28 and a window 30 in the side wall 28. A canopy 32, FIGS. 1–3, is positioned above the window 30. The window 30 can be opened, and functions as a drive-by window through which a driver of a vehicle can converse with an attendant in the building. The canopy 32 provides protection in the event of inclement weather.

Figure 4:
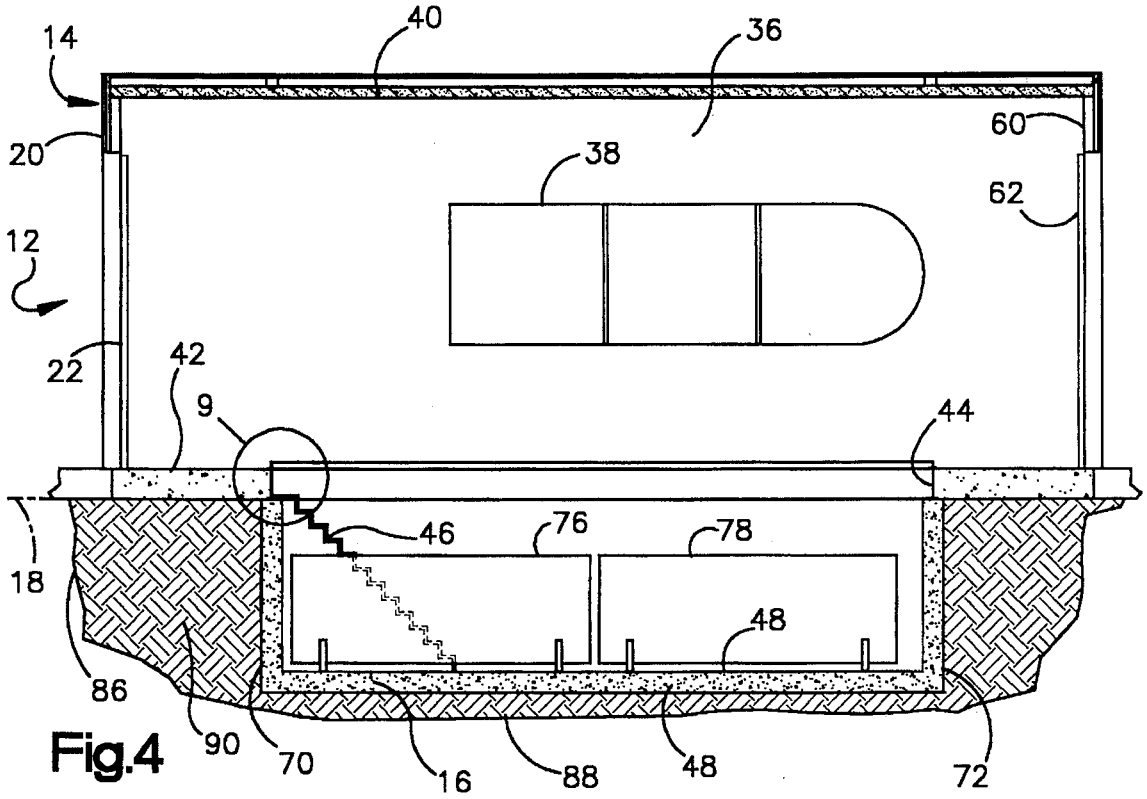
FIG. 4 is a section elevation view of the building of FIG. 1 taken along line 4—4 of FIG. 1.
Figure 5:
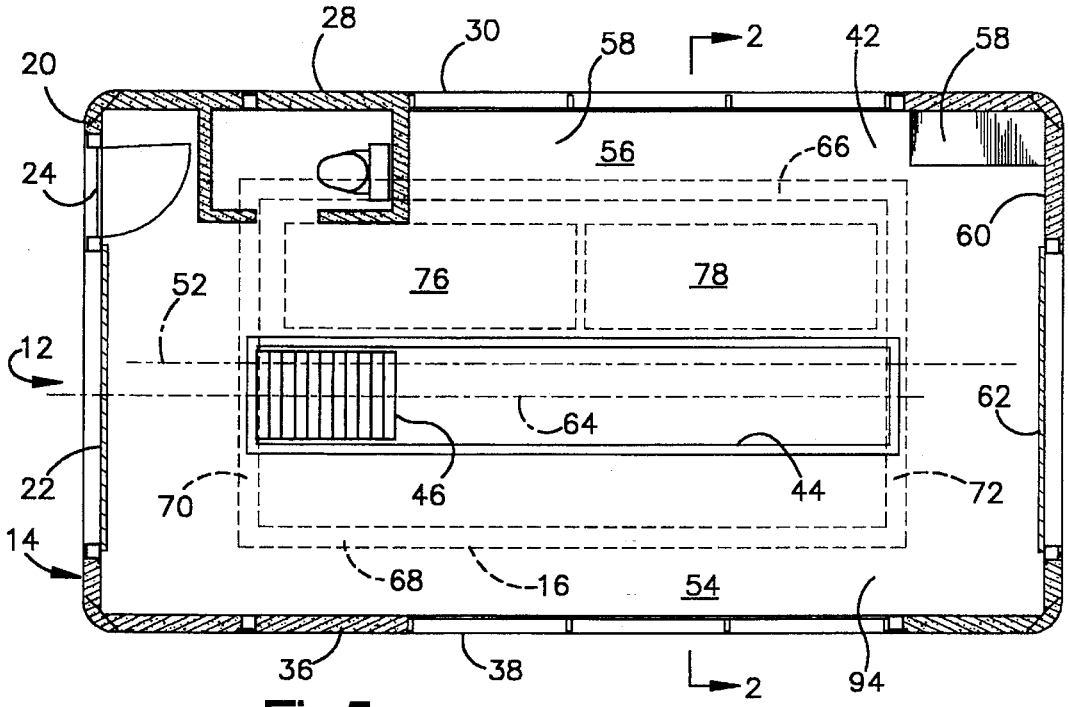
FIG. 5 is a plan, section view taken along line 5—5 of FIG. 1.

Further details of the building 12 of the present invention are shown in the section views of FIGS. 2, 4 and 5. Referring to FIG. 2, the above-grade enclosure 14 comprises a right side wall 36 which is opposite the left side wall 28, a window 38 in the right side wall 36, a roof 40, and a floor 42. The floor 42 has an opening 44 to provide access from the enclosure 14 to the vault 16. A stair 46 (FIG. 4) leads from the opening 44 to the floor 48 of the vault, for an attendant to descend from the enclosure 14 to the vault floor 48. As shown in FIGS. 2, 4 and 5, the enclosure 14 has a rear wall 60 which includes a rear door 62. The rear door 62 is similar in configuration to the front door 22 in the front wall 20 and can be raised along with the front door. When the doors 22 and 62 are raised, a vehicle can be driven in the front door 22, positioned above the floor opening 44, serviced, and then driven out the rear door 62 in a drive-through manner.

The enclosure 14 is rectangular in both horizontal and vertical cross-sections, as shown in FIGS. 2, 3 and 5. The enclosure 14 has a vertically extending longitudinal centerline 52 (FIGS. 2 and 5) which divides the enclosure into a right half 54 and a left half 56. The right and left halves are not mirror images. The floor opening 44, as shown in FIGS. 2 and 5, is offset from the centerline 52 so that a most of the opening 44 is predominantly in the floor of the enclosure right half 54. Similarly, the enlarged front and rear doors 22 and 62 (referring to FIGS. 1, 2 and 5) are predominantly in the right half 54 of the enclosure. When viewed from the top, as shown in FIG. 5, the centerline 64 is the centerline for both the doors 22 and 62 and the floor opening 44. This centerline 64 is to the right of the enclosure centerline 52. This allows a vehicle to be driven through the access of doors 22 and 62, when the doors are raised, and to be centered over the floor opening 44. Guides, not shown, can be located on the enclosure floor to guide the vehicle. When the vehicle is positioned over the floor opening, the vehicle is primarily in the right half of the enclosure.

Positioning the floor opening 44 predominantly in the right half of the enclosure, with the centerline 64 of the opening 44 offset to the right of the enclosure centerline 52, permits the enclosure left half 56 to accommodate accessories, broadly designated by the numeral 58, along the left side wall 28. These accessories 58 include such items as cabinets, tools, inventory, utilities, compressors, and restroom facilities. Since the vehicle is to one side in the enclosure, there is ample room on the opposite side for an attendant or customer to reach the accessories 58.

The vault 16 is also a rectangular enclosure. The vault has the floor 48, FIG. 2, upright side walls 66 and 68, FIG. 2, and upright end walls 70 and 72, FIG. 4, above the floor 48. The above-grade enclosure 14 is centered above the vault 16 so that the longitudinal centerline 80 (FIG. 2) of the vault and the longitudinal centerline 52 of the enclosure 14 are aligned, when viewed from the front in FIG. 2.

The length of the vault 16 is essentially the same as the length of the floor opening 44 as shown in FIG. 5. In a lateral direction, the width of the floor opening 44 is narrower than the width of the vault 16. The height of the vault, in walls 66, 68, 70 and 72, is sufficient to allow an attendant to stand up in the vault and service a vehicle positioned over the floor opening 44. This is a significant advantage of the present invention.

The building of the present invention comprises receptacles 76 and 78, FIGS. 2, 4 and 5, for new and used oil. As shown in FIGS. 2. 4 and 5, the receptacles are positioned in the vault 16 on the floor 48 of the vault. The vault 16 has a work area beneath the floor opening, for an attendant in the vault. The work area, as with the floor opening, is to one side of the vault centerline, and thus is primarily in one side of the vault. The vault is sized to accommodate the oil receptacles 76, 78 in the other side of the vault. This places the oil receptacles out of the vault work area.

By positioning the receptacles 76, 78 in the vault 16, the receptacles are below grade level, entirely contained within the vault.

The vault is one piece, preferably reinforced cast concrete. This eliminates the consequences of an oil spill. Oil which is spilled within the vault is completely contained by the vault. In addition, the receptacles 76 and 78 are removed from the traffic patterns of vehicles around the oil change and lubrication center, making the receptacles collision-proof. Further, this protects the receptacles 76, 78 from above-ground fires. In this respect the building of the present invention advantageously meets NFPA (National Fire Prevention Association) requirements.

Figure 8:
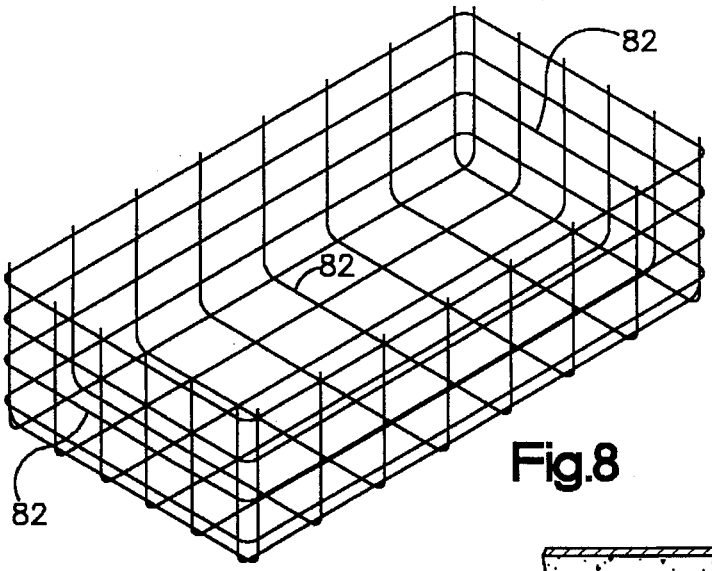
FIG. 8 is a schematic illustration of the reinforcing bar construction for the vault of the building of FIG. 1.

An aspect of the present invention is that the building 12 is transportable in multiple sections. In the embodiment of FIGS. 1–5, the building 12 is transportable in three sections. The vault 16 is transportable as one section, and, as mentioned, is preferably a one-piece reinforced cast concrete member. It has a reinforcing bar construction as shown in FIG. 8, in which the reinforcing bars 82 wrap around all corners of the vault. This makes the vault strong enough to withstand lifting and transportation and also strong enough to support the enclosure 14 and a vehicle positioned within the enclosure.

Instead of making the vault of reinforced cast concrete, other forms of construction can be used. The vault can be made of steel, or reinforced fiberglass, by way of example. An advantage in making the vault of one piece is that the vault can be easily raised onto a trailer. This makes the transported vault reusable should it be desirable to move the building of the present invention to a different site. The added expense, if any, that may be incurred by prefabricating the vault of one piece, is offset by reuse of the vault at a new site.

The enclosure 14 is separable along the centerline 52 (FIGS. 2 and 5), and is transportable as second and third sections, namely right half 54 and left half 56. Each section of the building, the vault 16, the enclosure right half 54, and the enclosure left half 56 are prefabricated and self-contained and can be separately transported. Each section is dimensioned so that it can be easily placed on the flat bed of a tractor-trailer.

By way of example, the dimensions of the vault are eleven feet in width, five feet and four inches in height, and twenty-one feet in length. In addition to providing a height which allows an attendant to work upright in the vault and a width which allows the attendant to work without interference from the oil receptacles, these dimensions also fortuitously allow the vault to easily fit on the bed of a tractor-trailer. Each above-grade enclosure half has a width of seven feet and nine inches, a length of thirty feet, and a height of twelve feet. These dimensions allow each enclosure half also to easily fit on the bed of a tractor-trailer. At the same time, the combined width of the enclosure, fifteen feet and six inches, fortuitously allows the enclosure to easily accommodate a vehicle as well as the accessories 58 associated with a lubrication and oil change center.

Means to be described are provided for easily connecting the left and right enclosure halves 54, 56 and the vault 16, at a selected site, and disconnecting them for transportation from one site to another. During transportation, the left and right enclosure halves 54, 56 can be suitably braced to allow the transportation.

When a location for the building 12 of the present invention is determined, an excavation 86 (FIGS. 2 and 4) is initially made. The excavation 86 is larger in dimension than the vault 16. The bottom of the excavation 86 is filled with a fill material 88, such as sand or gravel, to provide a footing for the vault. The vault 16 is then lowered into the excavation 86. The fill 88 is levelled, before lowering the vault into the excavation, so that the upper edges of the vault walls 66, 68, 70 and 72 are essentially at grade level. The excavation is then back-filled with additional fill material 90. If desired, drain tile (not shown) can be placed in the excavation 86 along with provisions for utilities and sewers (also not shown).

The enclosure 14 then seats on the upper edges of the vault walls 66, 68, 70 and 72. This is accomplished by providing the enclosure floor 42 with a flat plate 94, FIG. 5, and an I-beam layout 96 as shown in FIG. 6.

An advantage in making the vault 16 of reinforced cast concrete is that the combined weight of the vault and the building enclosure 14 is sufficient to prevent flotation of the building by ground water inadvertently filling the excavation 86.

Figure 6:
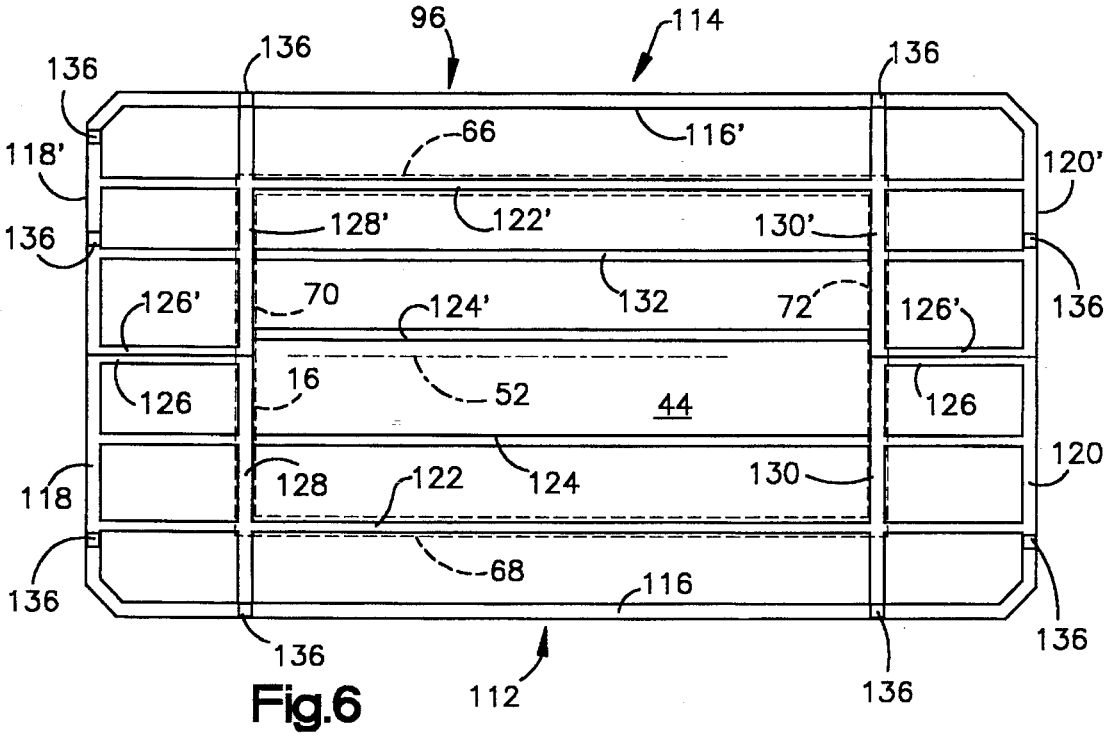
FIG. 6 is a plan view showing the I-beam layout for the floor construction of the building of FIG. 1.

Referring to FIG. 6, the beam layout comprises separable right and left halves 112 and 114. The separable halves are separable along centerline 52 (FIG. 6) and are not mirror images. The right half 112 comprises an outer longitudinally extending side beam 116, and outer laterally extending cross beams 118 and 120. The right half 112 also comprises first and second longitudinally extending inner beams 122 and 124, and longitudinally extending centerline beam sections 126 which are contiguous with the enclosure centerline 52. The right half 112 also includes laterally extending inner cross beams 128 and 130. The longitudinally extending first and second beams 122 and 124 extend the full length of the beam layout. The longitudinally extending centerline beams 126, extend only from the laterally extending outer cross beams 118, 120 to the inner laterally extending cross beams 128, 130.

Similarly, the left half 114 of the floor beam layout has a configuration defined by an outer longitudinally extending side beam 116', laterally extending outer cross beams 118', 120', a longitudinally extending first inner beam 122', a longitudinally extending second inner beam 124', longitudinally extending centerline beam sections 126', and laterally extending inner front and rear cross beams 128' and 130'. In addition, the right half has a longitudinally extending intermediate beam 132 between the beams 122' and 124'.

In FIG. 6, the vault 16 is shown in phantom lines. The beam layout 96 is divisible into three sets of beams. The first set comprises portions of inner longitudinally extending beams 122 and 122' and laterally extending inner cross beams 128, 128' and 130, 130'. This first set of beams seats on the upper edges of the vault walls 66, 68, 70 and 72, supporting the enclosure 14 on the vault. The second set comprises portions of inner longitudinally extending beams 124, 124' and laterally extending inner cross beams 128, 128', 130 and 130'. This set of beams defines the opening 44 within the floor 42 of the enclosure. The third set comprises longitudinally extending beams 116, 116', and laterally extending beams 118, 118', 120 and 120'. This third set of beams defines the outline of the enclosure. All of the beam sets are interconnected. The third set of beams 116, 116', 118, 118', 120 and 120' support posts 136, which in turn support the walls of the enclosure 14, and at their upper ends, support the roof 40 of the enclosure.

The interconnecting of the beam sets allows the enclosure 14 to overhang or extend beyond the confines of the vault 16 cantilevered from the vault walls.

Figure 7:
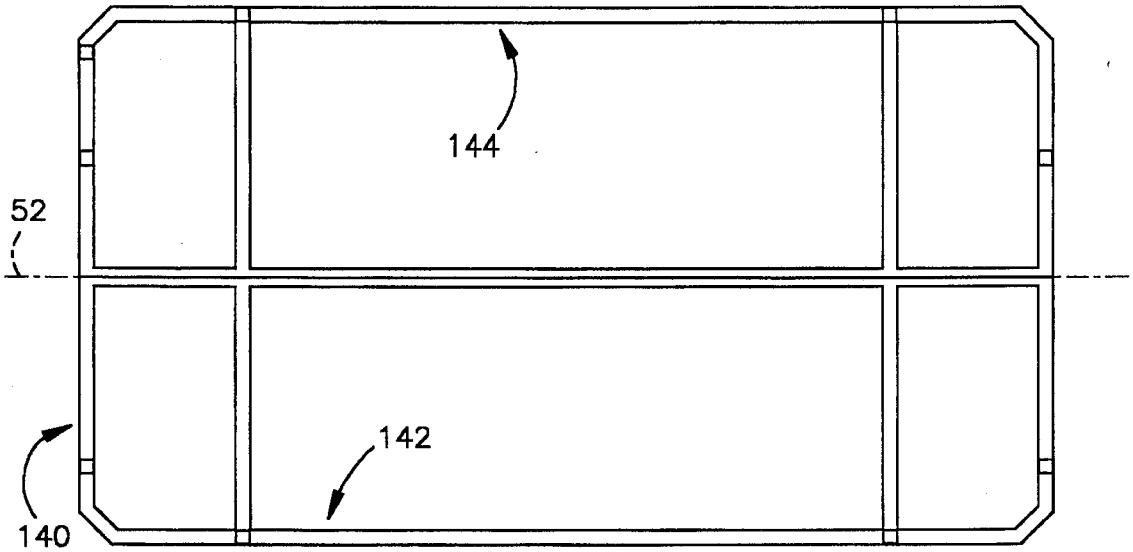
FIG. 7 is a plan view of the I-beam layout for the roof construction of the building of FIG. 1.

In FIG. 7, the roof I-beam layout 140 is shown. The roof layout is similar to that of the floor, but simpler in construction. The roof layout is separable along centerline 52 into two halves 142 and 144, similar to the halves 112, 114 of the floor layout.

Figure 9:
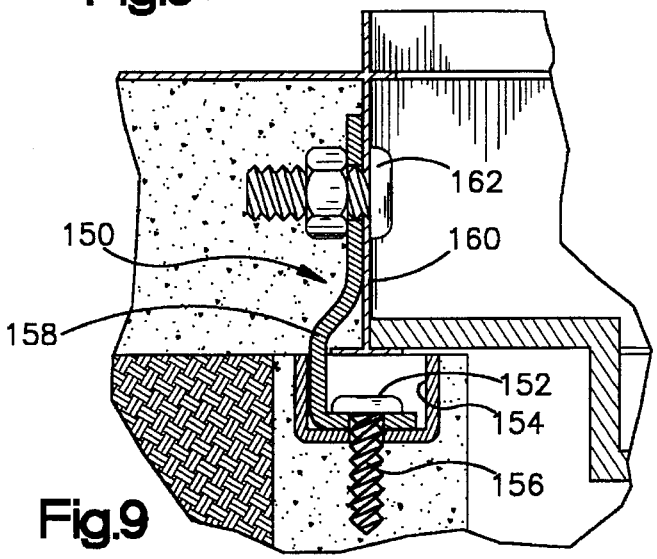
FIG. 9 is an enlarged illustration of a connector between the vault and the above-grade enclosure of the building of FIG. 1.

FIG. 9 illustrates a connection 150 which can be used to connect the enclosure halves 54, 56 to the vault 16, and also to each other. In FIG. 9, a mushroom head 152 is seated within a rectangular depression 154 in an upper edge of a wall of the vault, held to the wall by an anchor bolt 156. The mushroom head 152 is engaged by an anchor rod 158 which clamps to an enclosure beam 160 by a bolt 162. The anchor rod 158 can also be used for lowering the vault into an excavation and raising it from an excavation. By this construction, the anchor rod 158 can be removed during transportation. This prevents the connection 150 from inadvertent damage during the transportation. A similar or other construction can be employed to connect the enclosure halves 54, 56 together.

Figure 10:
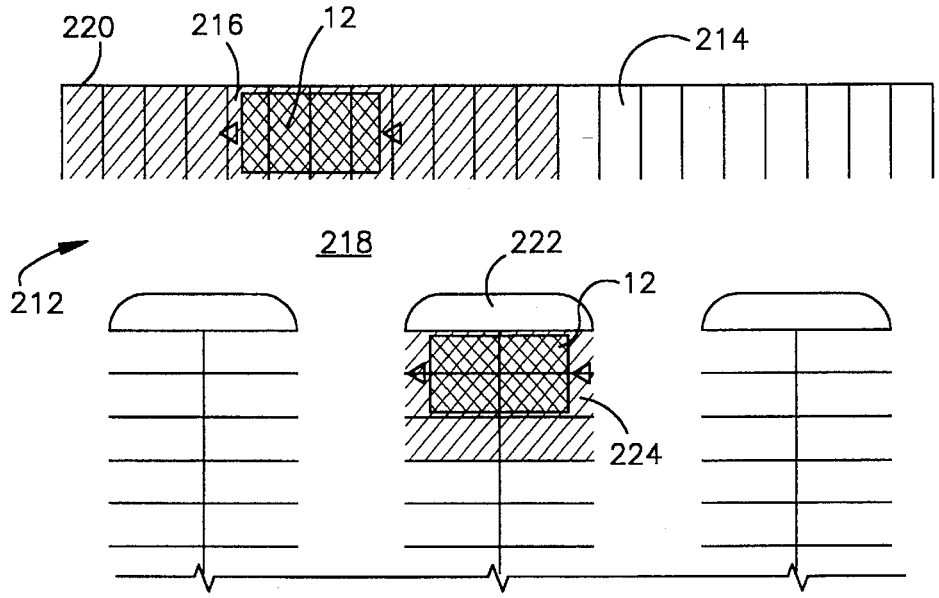
FIG. 10 is a site layout showing site locations for the building of FIG. 1.

FIG. 10 illustrates examples of site locations for the building 12 of the present invention. A parking lot 212, for a mall, has multiple parking spaces 214. The building 12 can be positioned in head-on parking spaces 216 between an aisle 218 and curbing 220. In such instance, the building 12 occupies about four spaces 216. Alternatively, the building 12 can be positioned next to an island 222 in drive-through spaces 224. Here also, the building 12 occupies about four spaces 224. Other site locations will be apparent to those skilled in the art.

Figure 11:
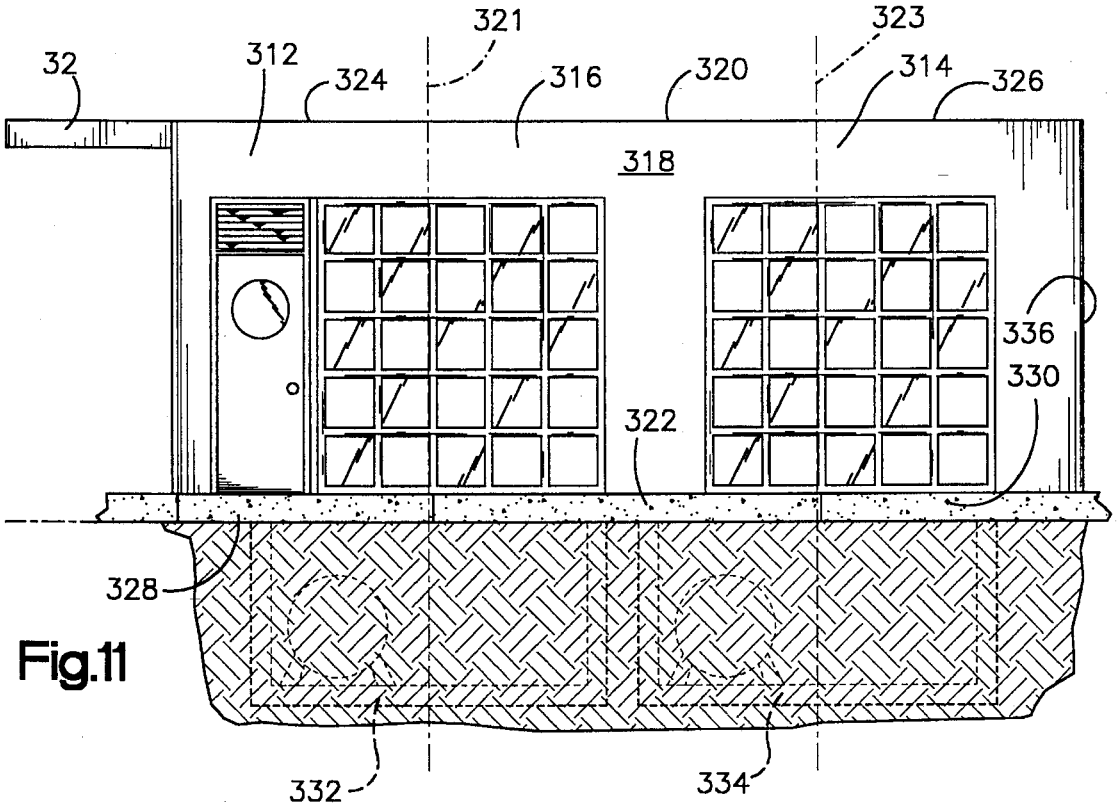
FIG. 11 is an end elevation partial section view showing a multi-bay modular building in accordance with the present invention.

The building 12 of the present invention can be installed as a multi-bay unit, or even converted to a multi-bay unit after installation. A two-bay unit is shown in FIG. 11. The unit has a left enclosure 312 and a right enclosure 314. The left and right enclosures are the same as the left and right halves described with respect to FIGS. 1–9. The two-bay unit also has an intermediate connecting enclosure 316. The connecting enclosure 316 has a center wall 318 in the front and a corresponding center wall (not shown) in the rear. The center walls support a roof 320, and in turn are supported by a floor structure 322. The left and right enclosures 312 and 314 are spaced apart, and the connecting enclosure 316, roof 320 and floor structure 322 span the distance between and connect with the roofs 324, 326 of the left and right enclosures and the floor structures 328 and 330 of said enclosures. The left and right enclosures 312 and 314 and the connecting enclosure 316 are separable at the centerlines 321 and 323. These centerlines are the centerlines for a first vault 332 shown in phantom lines positioned beneath both the left enclosure 312 and the intermediate connecting enclosure 316, and a second vault 334 is positioned beneath the right enclosure 314 and the intermediate connecting enclosure 316. The left vault 332 has side walls and end walls which connect with and support beams of both the left enclosure 312 and the intermediate connecting enclosure 316 (floor structure 322), in the manner described above with respect to FIGS. 1–9. The right vault 334 has side walls and end walls which connect with and support beams of both the intermediate connecting enclosure 316 (floor structure 322) and the right enclosure 314, also in the manner described above with respect to FIGS. 1–9.

The two-bay unit is open on the inside, and all accessories are located along the side wall 336 for the right enclosure 314. The intermediate enclosure 316 can be provided with a dividing wall between the two bays and accessories can be provided in each bay.

Further, more bays can be added, simply by employing additional intermediate connecting enclosures and additional vaults, with each bay having a vault and an enclosure area for servicing a vehicle above the vault.

Advantages of the present invention should now be apparent. A primary advantage is that the building of the present invention is readily transportable in multiple prefabricated sections. Thus, the prefabricated components can be readily transported from one site location to another, in the event a site location is found to be unprofitable.

At the same time, by providing the building of the present invention, whether a single bay or multiple bays, with a vault component, at below grade level, an attendant can service a vehicle while at the same time standing upright, rather than sliding beneath a vehicle on a dolly or similar means. In the present invention, the vault not only functions as an improved servicing means, but in addition as a foundation for the above-ground components. By providing the vault with a reinforced cast concrete construction, it is transportable and has adequate strength to meet all building requirements. It supports not only above-ground components but also a vehicle or vehicles being serviced in the building.

Another principal advantage is that the vault of the present invention functions as a housing for used oil and fresh or new oil receptacles, thereby better meeting the requirements of NFPA. The vault provides a leak-proof containment area for the receptacles and thereby avoids the consequences of an oil spill. The containment area, being below grade level makes the used and fresh oil receptacles collision proof, in contrast to lubrication centers where such components are positioned above-grade.

The vault also provides improved protection of the oil receptacles from fire.

From the above description of the invention, those skilled in the art will perceive improvements, changes and modifications. Such improvements, changes and modifications within the skill of the art are intended to be covered by the appended claims.

Having described the invention, the following is claimed:

1. A modular building for a vehicle oil change and lubrication center comprising:

(a) a one-piece vault positioned below grade, said vault having a floor, upstanding walls, and an open-top;

(b) an above-grade enclosure supported by said vault having upright walls, said above-grade enclosure comprising (i) a floor and floor opening therein and;

(ii) a door access for a vehicle which allows a vehicle to be positioned over said floor opening, the floor opening being aligned with the vault open top and permitting access from the enclosure to the vault; and (c) means releasably holding said enclosure to said vault;

said vault being dimensioned so that it is transportable on a truck-trailer bed and has a height effective for an attendant to stand up in the vault and service a vehicle positioned over said floor opening.

2. The building of claim 1 wherein said vault is of reinforced cast concrete.

3. The building of claim 2 wherein said vault comprises a top side and has a rectangular configuration when viewed from said top side and further comprises opposed end walls and opposed side walls, the above-grade enclosure being supported by the vault end and side walls and overhanging said end and side walls.

4. The building of claim 3 wherein said above-grade enclosure comprises at least two sections which are separable, each section being dimensioned to fit on a truck-trailer bed.

5. The building of claim 4 wherein said vault open top side circumscribes an area and said sections when fastened together provide a floor area greater than said area of the open top of the vault, the enclosure comprising floor beams which seat on the vault walls.

6. The building of claim 3 wherein said above-grade enclosure comprises two sections defining an enclosure outline, each section comprising a floor component which includes a floor plate and a beam layout beneath the floor plate, the beam layout comprising a first set of beams which engage said vault end and side walls, a second set of beams which embrace at least a part of the floor opening, and a third set of beams which define said enclosure outline, the beams being interconnected other than by the floor plate.

7. The building of claim 2 wherein said above-ground enclosure comprises an enclosure centerline and said vault comprises a vault centerline, and the above-ground enclosure is separable into first and second halves, the halves being attached to each other along said enclosure centerline, and said enclosure centerline and said vault centerline are aligned.

8. The building of claim 7 wherein said enclosure comprises halves on opposite sides of the enclosure centerline and opposed end walls and opposed side walls and said floor opening is offset with respect to said enclosure centerline and is primarily in one of said halves, said building comprising accessories which are positioned in the other of said halves along a side wall of said other half.

9. The building of claim 2 comprising receptacles for new and used oil, said receptacles being positioned in said vault.

10. The building of claim 9 having a longitudinal centerline and first and second sides on opposite sides of said centerline, and said floor opening is offset to said first side with regard to said centerline, said receptacles being offset to said second side with regard to said centerline.

11. The building of claim 10 wherein said vault comprises a top side and has a rectangular configuration when viewed from said top side and further comprises opposed end walls and opposed side walls and a work area beneath said floor opening primarily in one side of the vault, said vault being sized to accommodate said receptacles in the side of said vault opposite said one side and removed from said work area.

12. The building of claim 2 in which said vault has a reinforcing bar construction which embraces all corners of the vault.

13. The building of claim 12 wherein said vault has a rectangular configuration.

14. The building of claim 13 containing two receptacles for new and used oil positioned in said vault.

15. The building of claim 1 wherein said enclosure comprises a centerline and is separable along a line of separation into two halves, said line of separation being aligned with said enclosure centerline, each enclosure half being dimensioned to fit on a tractor-trailer bed.

16. The building of claim 15 wherein said halves are non-symmetrical, and said building comprises accessories accommodated by one of said halves, and said floor opening is primarily in the other of said halves.

17. The building of claim 16 wherein said enclosure comprises multiple lubrication bays, said enclosure comprising at least three sections each dimensioned to fit on a tractor-trailer bed.

18. The building of claim 17 comprising at least two vaults separated from each other, the enclosure comprising first and second side sections and an intermediate section between said side sections wherein the intermediate section is supported in part by one of said vaults and in part by the other of said vaults.

19. A method of construction for a modular, transportable building for a vehicle oil change and lubrication center comprising the steps of:

(a) providing an excavation;

(b) positioning a one-piece prefabricated vault in said excavation, said vault having a floor, walls, and an open top, said vault being dimensioned to fit on a truck-trailer bed;

(c) providing an above-grade enclosure comprising a floor, opposed walls, at least one wall opening for the drive-in of a vehicle, and an opening in said floor aligned with said wall opening, said enclosure being separable into at least two sections, each enclosure section being dimensioned to fit onto a truck-trailer bed; and (d) positioning said enclosure on said vault so that it is supported by the vault, said enclosure floor opening being aligned with said vault open top.

20. The method of claim 19 wherein said vault has end and side walls and said enclosure sections overhang said end and side walls.

21. The method of claim 20 wherein said vault has a height dimension which allows an attendant to stand upright in the vault while servicing a vehicle positioned over the enclosure floor opening.

22. The method of claim 19 wherein said building comprises multiple bays; comprising the steps of:

(a) providing at least two of said excavations spaced-apart from each other;

(b) positioning one of said vaults in each of said excavations;

(c) providing said above-grade enclosure comprising a first side section, a second side section and at least one intermediate section between said side sections, and (d) positioning said intermediate section so that it is supported in part by one of said vaults and in part by the other of said vaults.

23. The method of claim 19 wherein said vault is of reinforced cast concrete.

24. A modular building for a vehicle oil change and lubrication center comprising:

(a) a vault positioned below grade, said vault having a floor, upstanding walls, and an open-top, and being dimensioned so that it is transportable on a truck-trailer bed;

(b) an above-grade enclosure comprising at least two sections which are separable, each section being dimensioned to fit on a truck-trailer bed, said sections comprising (i) a floor and floor opening therein and;

(ii) a door access for a vehicle which allows a vehicle to be positioned over said floor opening, the floor opening being aligned with the vault open-top and permitting access from the enclosure to the vault; and (c) mechanical means releasably holding said enclosure to said vault.

25. The building of claim 24 wherein said vault is of one piece of reinforced cast concrete.

26. The building of claim 25 wherein said vault has a height dimension which allows an attendant to stand up in the vault while servicing a vehicle positioned over the floor opening.

27. The building of claim 25 wherein said vault has a rectangular configuration when viewed from said open top and further comprises opposed end walls and opposed side walls, the above-grade enclosure being supported by the vault end and side walls and overhanging said end and side walls.

28. The building of claim 27 wherein said above ground enclosure comprises an enclosure centerline and said vault comprises a vault centerline, and the above-ground enclosure is separable into first and second halves, the halves being attached to each other along said enclosure centerline, and said enclosure centerline and said vault centerline are aligned.

29. The building of claim 24 wherein said enclosure comprises an enclosure centerline and halves on opposite sides of the enclosure centerline and opposed end walls and opposed side walls and said floor opening is offset with respect to the enclosure centerline and is primarily in one of said halves, said building comprising accessories which are positioned in the other of said halves along a side wall of said other half.

30. A building made by the method of claim 19.

31. A modular building for a vehicle oil change and lubrication center comprising:

(a) a vault positioned below grade, said vault comprising a floor, upstanding walls, a centerline, opposed sides on opposite sides of said centerline, and an open-top, and being dimensioned so that it is transportable on a truck-trailer bed;

(b) an above-grade enclosure mechanically connected to said vault having upright walls, said above-grade enclosure comprising a centerline aligned with the centerline of the vault, opposed sides on opposite sides of said enclosure centerline, and further comprising (i) a floor and floor opening therein and;

(ii) a door access for a vehicle which allows a vehicle to be positioned over said floor opening;

the floor opening being over the vault open top and permitting access from the enclosure to the vault, said floor opening being offset to one side of said enclosure and vault centerlines and defining a work area in said vault to one side of said vault centerline; and (c) receptacles for new and used oil in said vault, said vault being sized to accommodate said receptacles in the side of said vault opposite from said vault one side and removed from the vault work area.

32. The building of claim 31 wherein said vault has a height dimension which allows an attendant to stand up in the vault while servicing a vehicle positioned over the floor opening.

33. The building of claim 32 wherein said vault has a first weight and said enclosure has a second weight and the combined weight of the vault and enclosure are sufficient to overcome flotation of the vault by ground water.

34. The building of claim 33 wherein said vault is one piece of reinforced concrete and said above-grade enclosure is supported by said vault.

35. A modular building for a vehicle oil change and lubrication center comprising:

(a) a one-piece vault positioned below grade, said vault comprising a floor, upstanding walls integral with said floor, and an open-top, and being dimensioned so that it is transportable on a truck-trailer bed, said vault having a longitudinally extending centerline;

(b) a modular above-grade enclosure which is truck-trailer transportable comprising (i) upright walls;

(ii) a floor and floor opening in said floor, and;

(iii) a door access for a vehicle in at least one of said enclosure walls which allows a vehicle to be positioned over said floor opening;

said floor opening being over the vault open top and permitting access from the above-grade enclosure to the vault, said vault being larger in dimension than said floor opening and comprising a work area which is coextensive with said floor opening, and a storage area which is separate from said work area; and (c) receptacles for new and used oil in said vault storage area, said vault storage area being sized to accommodate said receptacles and said vault functioning as a containment structure encompassing said receptacles.

36. A building according to claim 33 wherein said vault comprises opposed sides on opposite sides of said vault centerline and said above-grade enclosure floor opening is offset to one of said sides of said vault centerline, and said vault storage area is in the side of said vault opposite said one side.

37. A building according to claim 35 wherein said above-grade enclosure is supported by said vault.

38. A building according to claim 37 wherein said vault is of reinforced cast concrete.

39. A building according to claim 35 wherein said vault has a height dimension which allows an attendant to stand up in the vault while servicing a vehicle positioned over the floor opening.

40. A building according to claim 35 in which said above-grade enclosure is transportable in two pieces and has a longitudinally extending centerline, said vault and above-grade enclosure centerlines being aligned so that the enclosure floor opening is offset with respect to said enclosure centerline.

* * * * *